US010090612B2

(12) United States Patent
Benedict et al.

(10) Patent No.: US 10,090,612 B2
(45) Date of Patent: Oct. 2, 2018

(54) ELECTRICAL CABLE

(71) Applicant: 3M INNOVATIVE PROPERTIES COMPANY, St. Paul, MN (US)

(72) Inventors: John W. Benedict, Leander, TX (US); James G. Vana, Jr., Cedar Park, TX (US); Rocky D. Edwards, Lago Vista, TX (US); Mark T. Palmer, New Ulm, MN (US); Richard J. Scherer, Austin, TX (US); Steven A. Neu, Cedar Park, TX (US); Ching-Long Tsai, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/399,110

(22) Filed: Jan. 5, 2017

(65) Prior Publication Data

US 2017/0214163 A1 Jul. 27, 2017

Related U.S. Application Data

(60) Provisional application No. 62/286,164, filed on Jan. 22, 2016.

(51) Int. Cl.
*H01B 7/08* (2006.01)
*H01R 12/78* (2011.01)

(52) U.S. Cl.
CPC ..... *H01R 12/78* (2013.01); *H01B 7/0823* (2013.01); *H01B 7/0838* (2013.01); *H01B 7/0861* (2013.01)

(58) Field of Classification Search
CPC ..... H01B 7/08
USPC ..... 174/117 F
See application file for complete search history.

(56) References Cited

U.S. PATENT DOCUMENTS 3,406,514 A * 10/1968 Hanlon ..... H01B 13/0221 174/128.1
4,468,089 A 8/1984 Brorein
4,497,533 A 2/1985 Genova
4,596,897 A 6/1986 Gruhn
4,698,457 A 10/1987 Bordbar
5,387,113 A * 2/1995 Dickerson ..... H01B 7/0861 174/36
5,455,383 A 10/1995 Tanaka
5,900,588 A * 5/1999 Springer ..... H01B 7/0861 174/117 F
6,222,129 B1 * 4/2001 Siekierka ..... C08L 23/10 174/110 F
6,384,326 B1 5/2002 McFadden
(Continued)

FOREIGN PATENT DOCUMENTS

WO WO 2016-178861 11/2016

*Primary Examiner* — Chau N Nguyen
(74) *Attorney, Agent, or Firm* — Robert S. Moshrefzadeh

(57) ABSTRACT

A flat electrical cable is described. The cable includes a plurality of equally spaced substantially parallel electrical conductors lying in a same plane and extending along the length of the cable. Each conductor has a same diameter D. The cable further includes a common unitary electrically insulating layer encapsulating the plurality of conductors. The insulating layer includes a plurality of cover portions where each cover portion is concentric with a corresponding conductor and has a radial thickness t. t/D is in a range from about 0.50 to about 1.25.

25 Claims, 6 Drawing Sheets

(56) References Cited

U.S. PATENT DOCUMENTS

| | | | | |
|---|---|---|---|---|
| 6,635,826 | B2 | 10/2003 | Yamamoto | |
| 7,332,677 | B2 * | 2/2008 | Xu | H01B 3/427 174/110 R |
| 9,064,612 | B2 | 6/2015 | Gundel | |
| 2004/0235336 | A1 * | 11/2004 | Brekosky | H01R 4/2404 439/417 |
| 2007/0187133 | A1 * | 8/2007 | Amato | H01B 11/1895 174/117 F |
| 2014/0116750 | A1 * | 5/2014 | Suzuki | H01B 7/0823 174/117 F |
| 2014/0349513 | A1 | 11/2014 | Mathews | |
| 2014/0377971 | A1 | 12/2014 | Mathews | |
| 2015/0222029 | A1 | 8/2015 | Neu | |

* cited by examiner

ELECTRICAL CABLE

BACKGROUND

Electrical ribbon cables can be used to conduct high speed electrical signals (e.g., greater than 1 Gb/s) in electrical devices. Ribbon cables include a plurality of insulated parallel wires. Such cables may require the use of specifically designed connectors for termination and are often not suitable for the use of mass-termination techniques, e.g., the simultaneous connection of a plurality of conductors to individual contact elements. Although electrical cables have been developed to facilitate these mass-termination techniques, these cables often have limitations in the ability to mass-produce them, in the ability to prepare their termination ends, in their flexibility, and in their electrical performance.

SUMMARY

In some aspects of the present description, a flat electrical cable extending longitudinally along a length of the cable is provided. The electrical cable includes a plurality of equally spaced substantially parallel electrical conductors lying in a same plane and extending along the length of the cable. Each conductor has a same diameter D. The electrical cable further includes a common unitary electrically insulating layer encapsulating the plurality of conductor. The insulating layer includes a plurality of cover portions where each cover portion is concentric with a corresponding conductor and has a radial thickness t. t/D is in a range from about 0.50 to about 1.25.

DETAILED DESCRIPTION

In the following description, reference is made to the accompanying drawings that forms a part hereof and in which various embodiments are shown by way of illustration. The drawings are not necessarily to scale. It is to be understood that other embodiments are contemplated and may be made without departing from the scope or spirit of the present disclosure. The following detailed description, therefore, is not to be taken in a limiting sense.

Electrical ribbon cables typically include a plurality of parallel wires where each wire is surrounded by an insulator.

According to the present description, it has been found that a common unitary electrically insulating layer can be used to encapsulate the plurality of wires where the unitary insulating layer has a geometry which allows sufficient bendability of the cable while preserving suitable bonding to a shield laminate that may be adhered to the cable and that may include a metalized layer and an additional insulating jacket layer. When a shield laminate is attached to the unitary insulating layer, the shield laminate is strippable from the electrical cable in order to facilitate termination with a connector. The shield laminate may be robustly bonded to the insulating layer so that the electrical cables can provide a desired electrical performance (e.g., a predetermined impedance (e.g., between 85 and 100 ohms for differential signaling or 50 ohms for single ended signaling) and a low attenuation (e.g., less than −3 db/m at 3 Ghz or less than −6 db/m at 3 Ghz)) that is robust in a broad range of typical use conditions which include bending, folding and varying temperature and humidity. The cables may be used for one or more of differential signaling, single ended signaling, differential driven single ended signaling, and power.

Figure 1A:
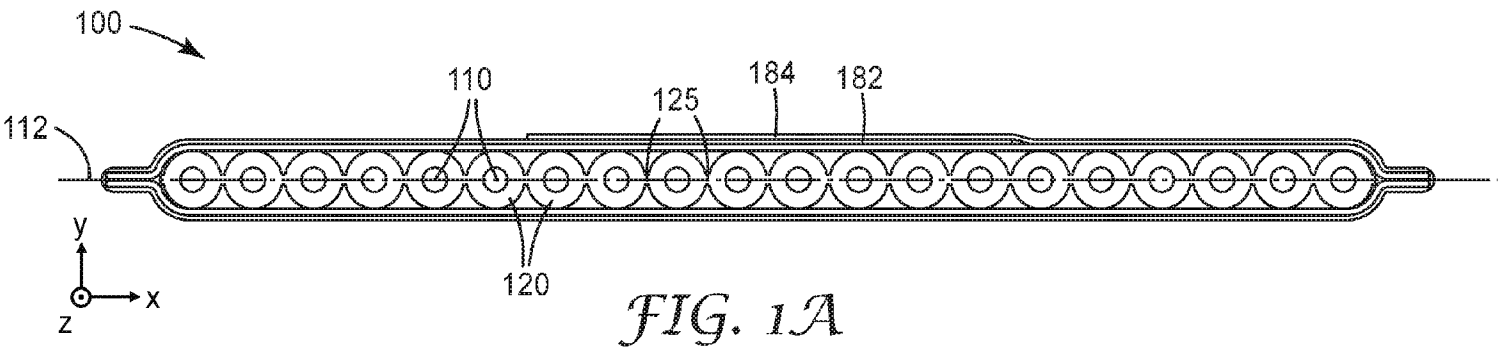
FIG. 1A is a cross-sectional view of an electrical cable.
Figure 1B:
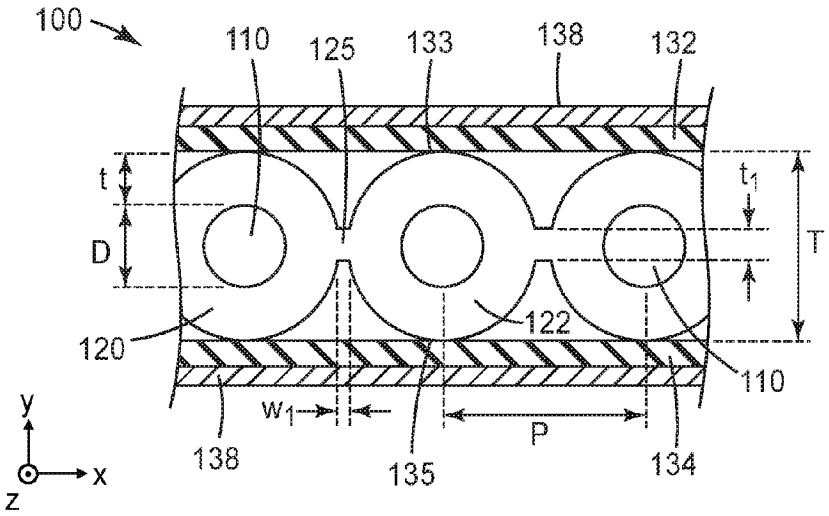
FIG. 1B is a cross-sectional view of a portion of the electrical cable of FIG. 1A.
Figure 1C:
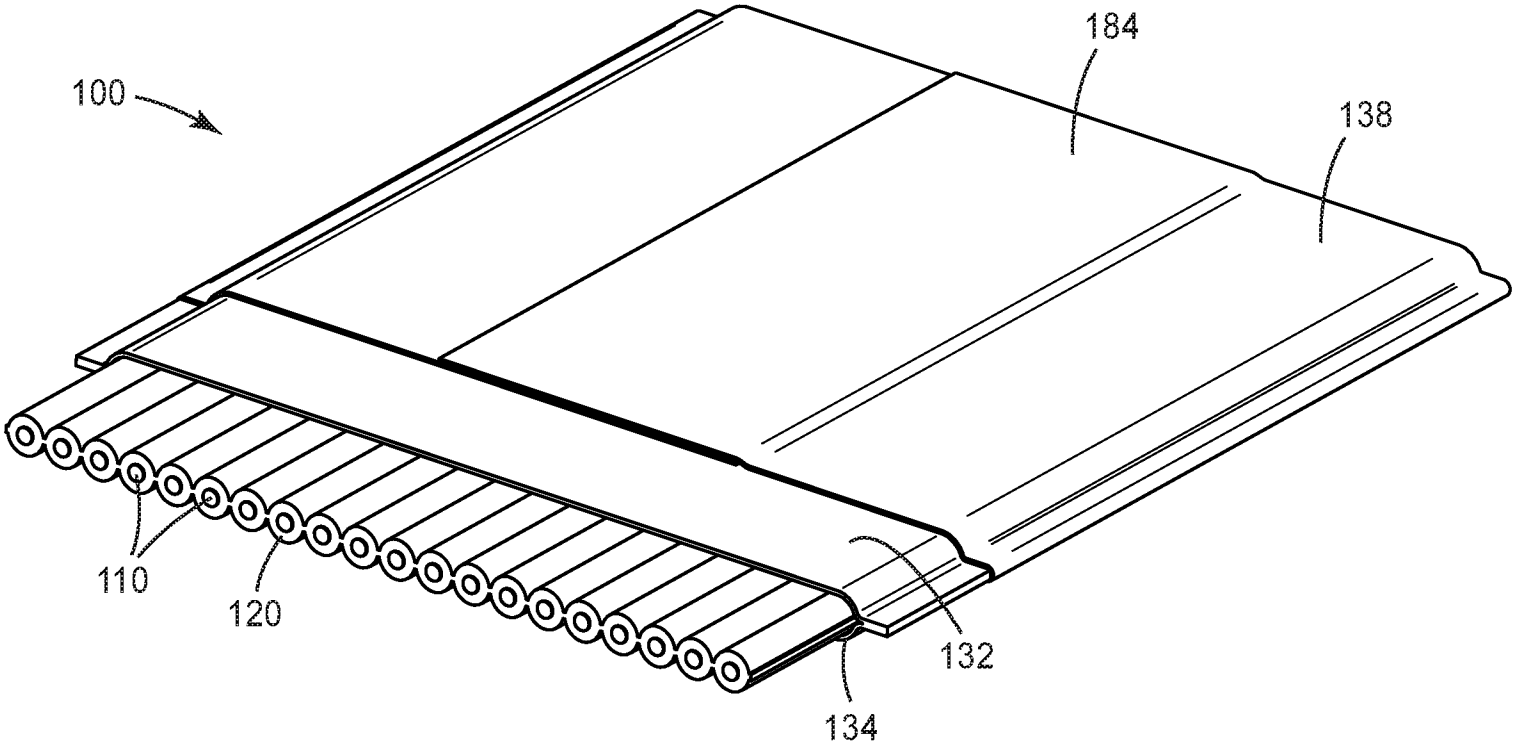
FIG. 1C is a perspective cutaway view of the electrical cable of FIG. 1A.

FIG. 1A is cross-sectional view of electrical cable 100, FIG. 1B is a cross-sectional view of a portion of electrical cable 100, and FIG. 1C is a perspective cutaway view of electrical cable 100. Electrical cable 100 is substantially flat in FIGS. 1A-1C and extends longitudinally along a length of the cable 100 (in the z-direction). Cable 100 includes a plurality of equally spaced substantially parallel electrical conductors 110 lying in a same plane 112 (parallel to the x-z plane) and extending along the length of the cable. Each conductor 110 has a diameter of D. In some embodiments, D is in a range from about 0.127 mm to about 0.51 mm. Cable 100 also includes a common unitary electrically insulating layer 120 encapsulating the plurality of conductors 110. Insulating layer 120 includes a plurality of cover portions 122, where each cover portion 122 is concentric with a corresponding conductor 110 and has a radial thickness oft and an outer diameter of T. It has been found that useful ranges for the ratio t/D may be from about 0.50 to about 1.25, or from about 0.53 to about 1.1. The insulating layer 120 further includes a plurality of land portions 125 where each land portion 125 connects adjacent cover portions 122. The land portions 125 have a substantially rectangular cross-section in a direction perpendicular to the length of the cable 100. In other words, land portions 125 have a substantially rectangular cross-section in the x-y plane which is perpendicular to the z-direction along the length of the cable 100. Land portions 125 have a thickness $t_1$ and a width $w_1$. In some embodiments, $t_1$ is in a range from about 127 micrometers to about 635 micrometers. In some embodiments, $w_1$ is in a range from about 50 micrometers to about 380 micrometers. In some embodiments, $t_1/w_1$ is in a range from about 1.5, or about 2.5, or about 4.1 to about 15.0, or about 13.5, or about 5.0. The conductors 110 are arranged at a pitch P. In some embodiments, P in a range from about 0.40 mm to about 1.35 mm. In some embodiments, $P/w_1$ is in a range from about 3.1 to about 25.5, or about 9.5 or about 5.5. Each cover portion has a thickness t. In some embodiments, t is in a range from about 0.127 or about 0.140 mm to about 0.275 mm or about 0.325 mm. In some embodiments, (2t+D)/P is in a range from about 0.60 or about 0.70 to about 1.30 or about 1.15.

Electrical cable 100 further includes first and second electrically conductive shielding films 132 and 134 disposed on opposite first and second sides 133 and 135 of and adhered to the insulating layer 120. As described further elsewhere herein, in some embodiments, each shielding film 132 and 134 includes a flat middle portion adhered to and covering the insulating layer 120 and an end portion adhered to the other shielding film on each lateral end of the insulating layer.

Electrical cable 100 further includes an electrically insulating jacket 138 longitudinally wrapped around the shielding films 132 and 134. As described further elsewhere herein, in some embodiments, a lateral end 184 of the jacket 138 overlaps and is adhered to an opposite lateral end 182 of the jacket 138. In some embodiments, the jacket is adhered to the shielding films 132 and 134. In other embodiments, the shielding films 132 and 134 may be omitted. In such embodiments, the jacket 138 may be longitudinally wrapped around the insulating layer 120 and may be adhered to insulating layer 120.

The conductors 110 may be wires adapted for maximum data transmission rates of at least 100 Mb/s, or at least 1 Gb/s, or at least 3 Gb/s, for example. A cable system including the cable 100 terminated with a connector at one or both ends of the cable 100 may be adapted for maximum data transmission rates of at least 100 Mb/s, or at least 1 Gb/s, or at least 3 Gb/s, for example. The wire gage may be in a range of 20 AWG to 34 AWG, or 26 to 31 AWG, for example. The conductors 110 may be solid or stranded and may be made from copper, tin, silver, copper alloy with no plating, copper alloy with tin plating, copper alloy with gold plating, or copper alloy with silver plating, for example.

In some embodiments, the conductors 110 may include one or more ground conductors and one or both of the shielding films 132 and 134 may be bonded to one or more of the ground conductors. The shielding films 132 and 134 can be bonded to the ground conductors with an ultrasonic weld (e.g., a 40 kHz ultrasonic weld), for example. Such bonding can be utilized near one or both ends of the cable near a connector as described in U.S. 62/155,599, filed May 1, 2015 and entitled "CONNECTOR ASSEMBLY", for example. This may be done in order for the shielding films 132 and 134 to provide improved electromagnetic interference (EMI) shielding at low frequencies, and this can improve the performance of the cable in single ended signaling applications.

The insulating layer 120 can be formed around the conductors 110 via extrusion, for example. In some cases, the insulating jacket 138 may be extruded over the insulating layer 120. Suitable material for insulating layer 120 and/or insulating jacket 138 include extrudable thermoplastics such as thermoplastic elastomer (TPE), polyolefin (PO) such as polyethylene (PE) and polypropylene (PP), polyvinyl chloride (PVC), polytetrafluoroethylene (PTFE), and fluorinated ethylene propylene (FEP), for example. The material chosen for the insulating layer 120 may have a dielectric constant less than about 3.0, or less than about 2.5, and may have a maximum elongation of greater than 100 percent.

In some embodiments, the insulating jacket 138 may be adhered to the shielding films 132 and 134 or to the insulating layer 120 with an adhesive. In some embodiments, the shielding films 132 and 134 may be adhered to the insulating layer 120 with an adhesive. Suitable adhesives for use in either case include pressure sensitive adhesives (PSAs) and hot melt adhesives.

Figure 8:
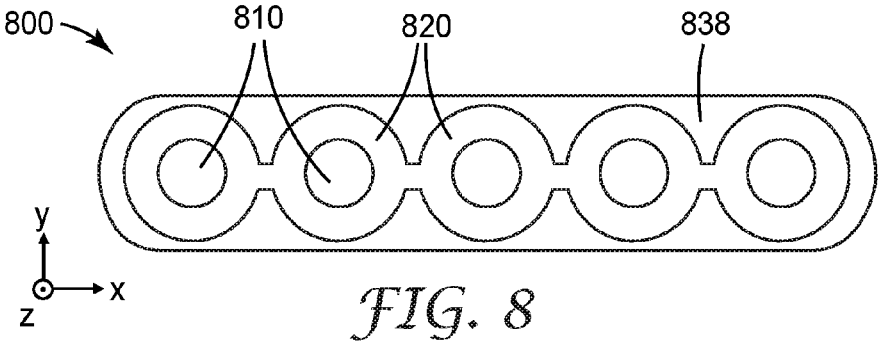
FIG. 8 is a schematic cross-sectional view of an electrical cable.

Shielding films 132 and 134 may be any type of film capable of providing electromagnetic shielding to cable 100. Suitable shielding films are known in the art (see, e.g., U.S. Pat. No. 9,064,612 (Gundel), which is hereby incorporated herein by reference to the extent that it does not contradict the present description). Shielding films 132 and 134 may include metalized film, metal foil, braided copper (or other metal) or expanded copper (or other metal), for example. Shielding films 132 and 134 may include metal foil (e.g., aluminum foil) laminated to a substrate or laminated between two substrates. Suitable substrates include polymeric substrates such as polyethylene terephthalate (PET). In some embodiments, the thickness and material choice (which determines a dielectric constant) of a substrate between a metal shielding layer and the insulating layer 120 and/or the thickness and material choice of an adhesive between the metal shielding layer and the insulating layer 120 may be selected to give a desired impedance. Cable 100 may have any useful impedance. For example, the impedance may be in the range of 40 to 110 ohms, or 50 to 105 ohms, or 80 to 105 ohms, or 85 to 100 ohms. In some embodiments, the impedance may be in a range of 40-60 ohms (e.g., about 50 ohms) for single ended applications. In some embodiments, the impedance may be in a range of 75-110 ohms, or 85 to 100 ohms for single differential applications. In some embodiments, the shielding film may be omitted and the electrically insulating jacket may be extruded over and may fully surround the insulating layer. This is illustrated in FIG. 8 which shows electrical cable 800 including a plurality equally spaced substantially parallel electrical conductors 810 and including a common unitary electrically insulating layer 820 encapsulating the plurality of conductors 810. Electrically insulating jacket 838 is extruded over and fully surrounds the insulating layer 820. Electrical conductors 810 and insulating layer 820 may have the same geometry as described for electrical conductors 110 and insulating layer 120. The configuration of electrical cable 800 can improve the bond of the insulating jacket 838 to the insulating layer 820.

Figure 2:
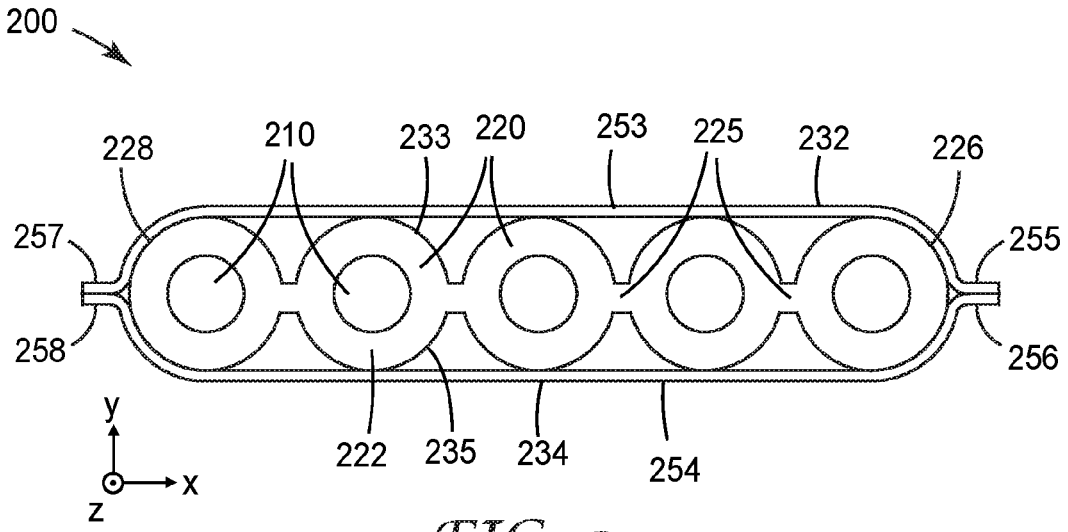
FIG. 2 is a schematic cross-sectional view of an electrical cable.

FIG. 2 is a schematic cross-sectional view of electrical cable 200 including a plurality of equally spaced substantially parallel electrical conductors 210, a common unitary electrically insulating layer 220 encapsulating the plurality of conductors 210, and first and second electrically conductive shielding films 232 and 234 disposed on opposite first and second sides 233 and 235, respectively, of insulating layer 220. The first and second shielding films 232 and 234 may be adhered to the first and second sides 233 and 235, respectively, of the insulating layer 220. Each shielding film 232 and 234 includes a flat middle portion 253 and 254, respectively, which may be adhered to and may cover the insulating layer 120. In other embodiments, one or both of the middle portions 253 and 254 may be contoured to follow the shape of the insulating layer 220. Shielding film 232 includes end portions 255 and 257, and shielding film 234 includes end portions 258 and 256. End portion 255 of shielding film 232 is adhered to the end portion 256 of shielding film 234 at lateral end 226 of the insulating layer 220, and end portion 257 of shielding film 232 is adhered to the end portion 258 of shielding film 234 at lateral end 228 of the insulating layer 220.

Figure 3A:
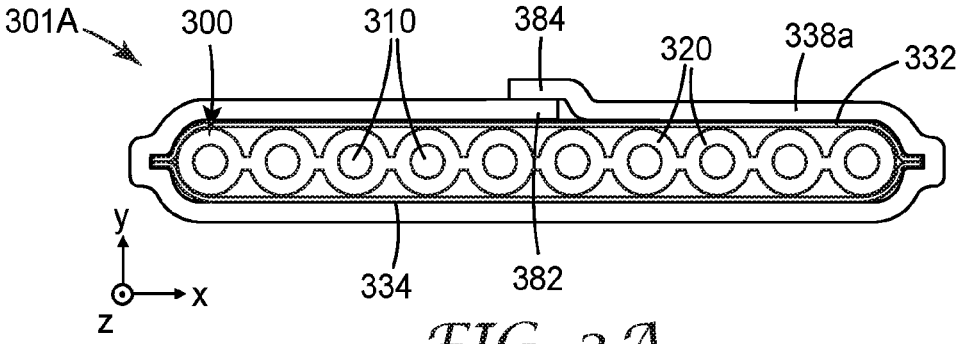
FIGS. 3A-3B are schematic cross-sectional views of electrical cables.
Figure 3B:
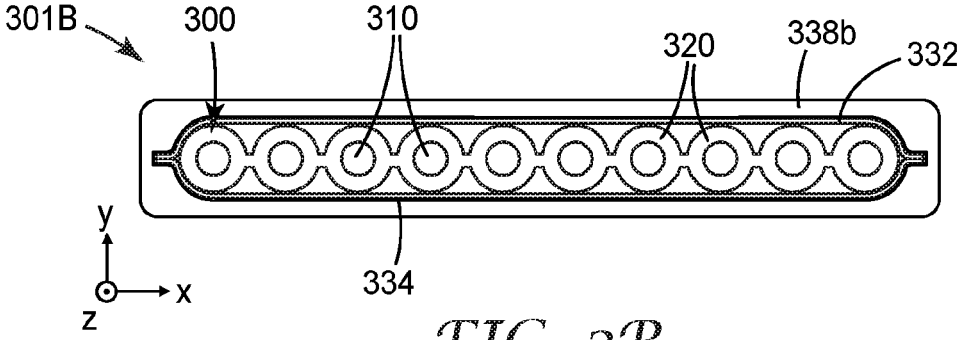
Figure 4:
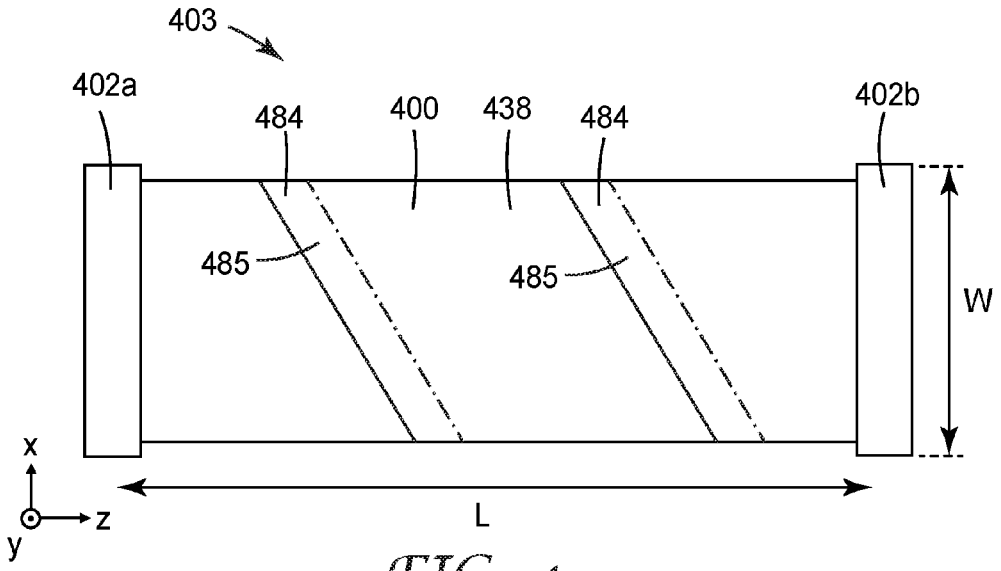
FIG. 4 is a schematic top view of a cable assembly.

FIG. 3A is a schematic cross-sectional view of jacketed electrical cable 301A which includes an electrical cable 300 with an electrically insulating jacket 338*a* longitudinally or spirally wrapped around the electrical cable 300. Electrical cable 300 includes a plurality of equally spaced substantially parallel electrical conductors 310 and a common unitary electrically insulating layer 320 encapsulating the plurality of conductors 310 as described elsewhere herein. In the illustrated embodiment, electrical cable 300 further includes first and second electrically conductive shielding films 332 and 334 disposed on opposite sides of and adhered to the insulating layer 320. In other embodiments, the shielding films 332 and 334 may be omitted. Electrical cable 300 may correspond to electrical cable 200, for example, and jacketed electrical cable 301A may correspond to electrical cable 100, for example. Insulating jacket 338*a* includes opposite lateral ends 382 and 384. Lateral end 384 of the jacket 338*a* overlaps and is adhered to an opposite lateral end 382 of the jacket 338*a*. Lateral ends 384 and 382 of the jacket 338*a* may overlap near the center of electrical cable 300 as illustrated in FIG. 3A or may overlap along other portions of the cable 300, for example, at a longitudinal side of the cable 300. In some embodiments, the electrical cable 300 includes shielding films as described elsewhere herein and the jacket 338*a* is adhered to the shielding films. In some embodiments, the shielding films are omitted and the jacket 338*a* is adhered to the unitary insulating layer. An alternate embodiment is shown in FIG. 3B which is a schematic cross-sectional view of jacketed electrical cable 301B which includes the electrical cable 300 with an electrically insulating jacket 338*b* extruded over and fully surrounding the shielding films 332 and 334. One or both ends of the cables may be terminated at a connector. This is schematically illustrated in FIG. 4 which shows cable assembly 403 that includes electrical cable 400, which may correspond to any of the electrical cables described elsewhere herein, terminated at connectors 402*a* and 402*b*. Electrical cable 400 extends longitudinally along a length L of the cable 400 (in the z-direction) and has a width W. Electrical cable 400 includes an insulating jacket 438 spirally wrapped around the shielding films or insulating layer of the cable. A lateral end 484 of the jacket overlaps and is adhered to an opposite lateral end of the jacket (below lateral end 484 indicated by the regions 485 between the solid and dotted lines in FIG. 4). Connectors 402*a* and 402*b* may be any type of electrical connector, such as, for example, insulation-displacement contact (IDC) connectors. Suitable connectors include those described in US 2014/0349513 (Mathews et al.), US 2014/0377971 (Mathews et al.), and US 2015/0222029 (Neu et al.), for example, each of which is hereby incorporated by reference herein to the extent that it does not contradict the present description. The connectors 402*a* and 402*b* may be attached to the cable 400 by stripping a portion of the jacket and shield from the insulation layer so that the cable 400 can be attached to an IDC connector, for example. Stripping can be conducted using common mechanical tools such as flat or contoured blade strippers, sharp bladed hand tools, or other tools such as a laser for scoring or stripping of the jacket and shield layers, for example.

Figure 5A:
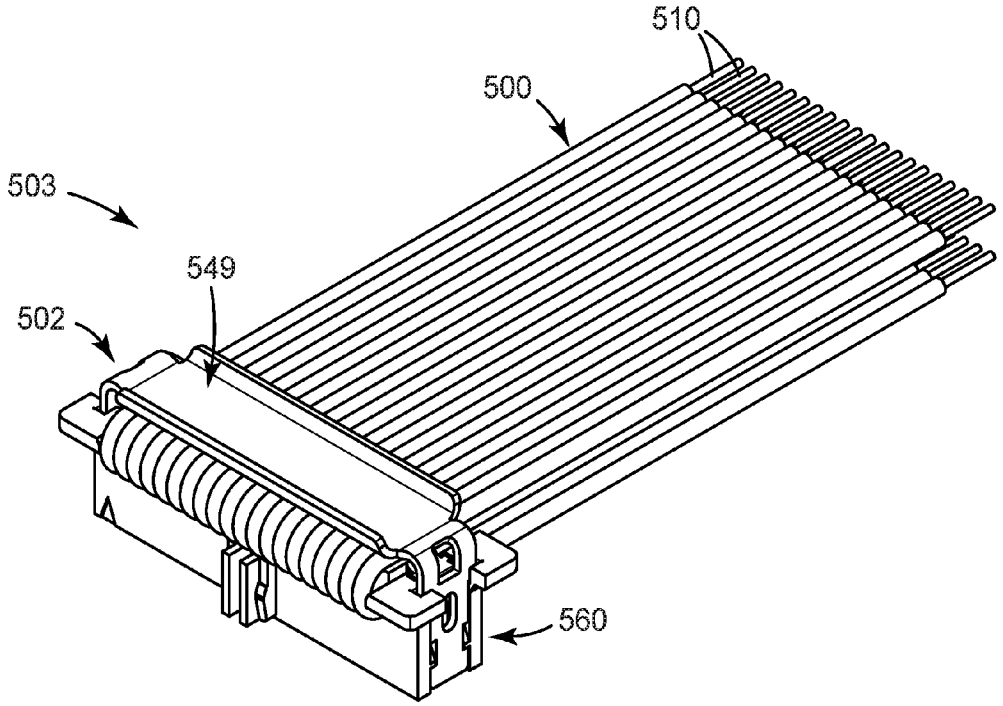
FIG. 5A is a perspective view of a cable assembly.
Figure 5B:
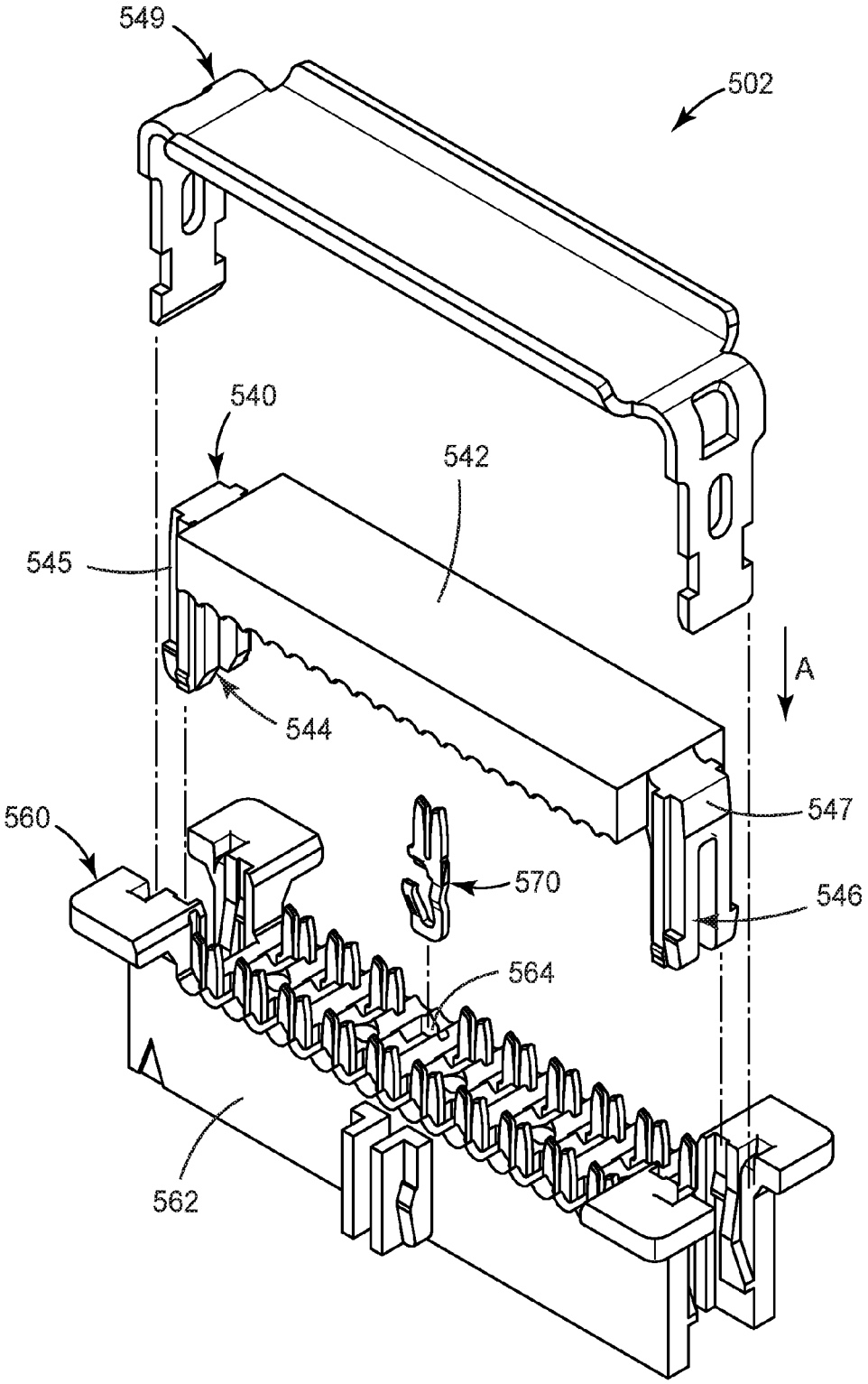
FIG. 5B is an exploded perspective view of a connector.

FIG. 5A is a perspective view of cable assembly 503 which includes electrical cable 500 and connector 502, and FIG. 5B is an exploded perspective view of connector 502. Electrical cable 500, which may correspond to any of the electrical cables described elsewhere herein, includes a plurality of equally spaced substantially parallel electrical conductors 510. Connector 502 includes an insulative housing 560, which includes a longitudinal body portion 562 having a plurality of contact openings 564 extending therein in an insertion direction (direction A in FIG. 5B), a plurality of electrical contact terminals 570 supported in the contact openings 564, and a cover 540 disposed on the housing 560 and including a longitudinal body portion 542 and first and second cover latches 544 and 546 extending from opposing longitudinal ends 545 and 547 of the cover 540 in the insertion direction and latched onto the housing 560. The cable 500 is disposed between the cover 540 and the housing 560. Each contact terminal 570 penetrates the insulating layer of the cable 500 and makes electrical and physical contact with a corresponding conductor 510 (as schematically illustrated further in FIG. 6). Connector 502 also includes optional strain relief 549, which may be included to securely retain a terminated electrical cable 500 to prevent the termination from being compromised, e.g., during handling or movement of the electrical cable 500, when securely attached to the connector housing 560. Further details on connector 502 can be found in US 2014/0349513 (Mathews et al.), previously incorporated by reference herein.

Figure 6:
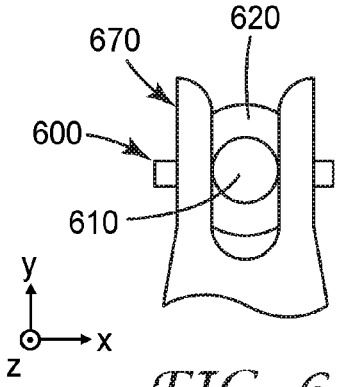
FIG. 6 is a schematic cross-sectional view of a portion of an electrical cable and a portion of a contact terminal.

FIG. 6 is a schematic cross-sectional view of a portion of electrical cable 600, which may correspond to electrical cable 500, and a portion of a contact terminal 670, which may correspond to one of the contact terminals 570. Cable 600 includes insulating layer 620 and electrical conductor 610. Contact terminal 670 penetrates the insulating layer 620 of the cable 600 and makes electrical and physical contact with conductor 610.

Figure 7:
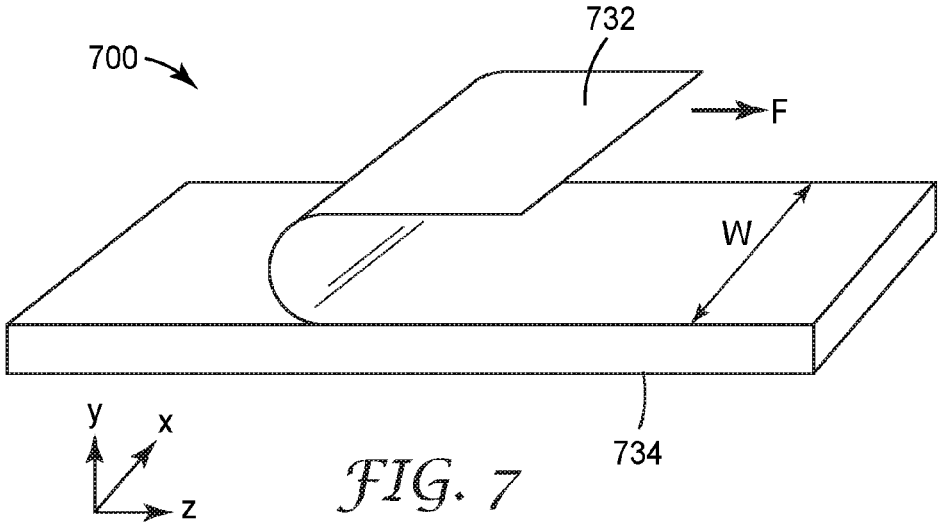
FIG. 7 schematically illustrates determining the force required to separate a shielding film from an electrical cable.

FIG. 7 is a schematic perspective view illustrating determining the force F required to separate shielding film 732 from the insulating layer of cable 700. In order to determine the adhesion of the shielding film 732 to the insulating layer of cable 700, the lateral ends of the cable 700 are skived off prior to peeling off the shielding film 732 so that the bonding of shielding film 732 to shielding film 734 does not affect the peel force results. Prior to skiving, cable 700 may correspond to cable 200 of FIG. 2, for example, and shielding films 732 and 734 may be bonded to each other at end portions on each lateral end (ends in the x-direction) of the insulating layer as illustrated in FIG. 2. Skiving can be performed by cutting through the outermost land portions of the cable 700 at each lateral end of the cable. This removes the outermost conductors from the cable as well as portions of the shielding films bonded at the lateral ends. After skiving, the shielding film 732 has a width W. The force F is determined by peeling shielding film 732 from cable 700 along the length (in the z-direction) of the cable 700 at a 180 degree angle (the force is applied in the z-direction when the cable 700 is disposed in the x-z plane with the width of the cable in the x-direction and the length of the cable in the z-direction) as illustrated in FIG. 7. A suitable peel force can be obtained by suitable selection of an adhesive, which may be a PSA and a hot melt adhesive, between the shielding film and the insulating layer. Other factors influencing peel force include the geometry of the common unitary electrically insulating layer encapsulating the plurality of conductors (e.g., a larger outer diameter T can provide a larger contact area and therefore a larger peel force). In some embodiments, the force is in a range from about 0.5 pounds per inch (about 88 N/m) of skived shield width W to about 2.5 pounds per inch (about 440 N/m) of skived shield width W. It has been found that a peel force in this range provides adequate bonding so that the shielding films 732 and 734 do not delaminate from the insulating layer 720 during typical use conditions. This ensures that the shielding films 732 and 734 remain at the desired distance from the conductors 710 so that the electrical performance of the cable 700 is maintained in a broad range of typical use conditions which include bending, folding and varying temperature and humidity.

The following is a list of exemplary embodiments of the present description.

Item 1 is a flat electrical cable extending longitudinally along a length of the cable and comprising:

a plurality of equally spaced substantially parallel electrical conductors lying in a same plane and extending along the length of the cable, each conductor having a same diameter D;

a common unitary electrically insulating layer encapsulating the plurality of conductors and including:

a plurality of cover portions, each cover portion concentric with a corresponding conductor and having a radial thickness t, t/D in a range from about 0.50 to about 1.25.

Item 2 is the flat electrical cable of Item 1, wherein t/D is in a range from about 0.53 to about 1.10.

Item 3 is the flat electrical cable of Item 1 or Item 2, wherein the insulating layer further comprises a plurality of land portions, each land portion connecting adjacent cover portions, having a substantially rectangular cross-section in a direction perpendicular to the length of the cable, and having a thickness $t_1$ and a width $w_1$, $t_1/w_1$ in a range from about 1.5 to about 15.0.

Item 4 is the flat electrical cable of Item 3, wherein $t_1/w_1$ is in a range from about 1.5 to about 13.5.

Item 5 is the flat electrical cable of Item 4, wherein $t_1/w_1$ is in a range from about 2.5 to about 5.0.

Item 6 is the flat electrical cable of any of Items 3 to 5, wherein the conductors are arranged at a pitch P, $P/w_1$ in a range from about 3.1 to about 25.5.

Item 7 is the flat electrical cable of Item 6, wherein $P/w_1$ is in a range from about 3.1 to about 9.5.

Item 8 is the flat electrical cable of Item 7, wherein $P/w_1$ is in a range from about 3.1 to about 5.5.

Item 9 is the flat electrical cable of any of Items 3 to 8, wherein $t_1$ is in a range from about 127 micrometers to about 635 micrometers.

Item 10 is the flat electrical cable of any of Items 1 to 9 further comprising first and second electrically conductive shielding films disposed on opposite first and second sides of and adhered to the insulating layer, each shielding film including a flat or contoured middle portion adhered to and covering the insulating layer and an end portion adhered to the other shielding film on each lateral end of the insulating layer.

Item 11 is the flat electrical cable of Item 10, wherein a force required to separate one of the first and second shielding films from the insulating layer along the length of the cable at a 180 degree peel angle is in a range from about 0.5 pounds/inch to about 2.5 pounds/inch.

Item 12 is the flat electrical cable of Item 10 or Item 11 further comprising an electrically insulating jacket longitudinally or spirally wrapped around the shielding films, a lateral end of the jacket overlapping and adhered to an opposite lateral end of the jacket.

Item 13 is the flat electrical cable of Item 12, wherein the jacket is adhered to the shielding films.

Item 14 is the flat electrical cable of Item 10 or Item 11 further comprising an electrically insulating jacket extruded over and fully surrounding the shielding films.

Item 15 is the flat electrical cable of any of Items 1 to 9 further comprising an electrically insulating jacket longitudinally or spirally wrapped around the insulating layer, a lateral end of the jacket overlapping and adhered to an opposite lateral end of the jacket.

Item 16 is the flat electrical cable of any of Items 1 to 9 further comprising an electrically insulating jacket extruded over and fully surrounding the insulating layer.

Item 17 is the flat electrical cable of Item 16, wherein the jacket is adhered to the insulating layer.

Item 18 is the flat electrical cable of any of Items 1 to 17, wherein the conductors are arranged at a pitch P and each cover portion has a thickness t, wherein (2t+D)/P is in a range from about 0.60 to about 1.30.

Item 19 is the flat electrical cable of Item 18, wherein (2t+D)/P is in a range from about 0.70 to about 1.15.

Item 20 is the flat electrical cable of any of Items 1 to 19, wherein t is in a range from about 0.127 mm to about 0.325 mm.

Item 21 is the flat electrical cable of Item 20, wherein t is in a range from about 0.140 mm to about 0.325 mm.

Item 22 is the flat electrical cable of any of Items 1 to 21, wherein the insulating layer further comprises a plurality of land portions, each land portion connecting adjacent cover portions, having a substantially rectangular cross-section in a direction perpendicular to the length of the cable, and having a width $w_1$, wherein $w_1$ is in a range from about 50 micrometers to about 380 micrometers.

Item 23 is the flat electrical cable of any of Items 1 to 22, wherein the conductors are arranged at a pitch P, P in a range from about 0.40 mm to about 1.35 mm.

Item 24 is the flat electrical cable of any of Items 1 to 23, wherein D is in a range from about 0.127 mm to about 0.51 mm.

Item 25 is a cable assembly comprising:

a connector comprising:

an insulative housing including a longitudinal body portion having a plurality of contact openings extending therein in an insertion direction;

a plurality of electrical contact terminals supported in the contact openings; and a cover disposed on the housing and including a longitudinal body portion and first and second cover latches extending from opposing longitudinal ends thereof in the insertion direction and latched onto the housing; and the cable of any of Items 1 to 24 disposed between the cover and the housing, each contact terminal penetrating the insulating layer and making electrical and physical contact with a corresponding conductor.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A flat electrical cable extending longitudinally along a length of the cable and comprising:

a plurality of equally spaced substantially parallel electrical conductors lying in a same plane and extending along the length of the cable, each conductor having a same diameter D;

a common unitary electrically insulating layer encapsulating the plurality of conductors and including:

a plurality of cover portions, each cover portion concentric with a corresponding conductor and having a radial thickness t, t/D in a range from about 0.50 to about 1.25, wherein the insulating layer further comprises a plurality of land portions, each land portion connecting adjacent cover portions, having a substantially rectangular cross-section in a direction perpendicular to the length of the cable, and having a thickness $t_1$ and a width $w_1$, $t_1/w_1$ in a range from about 2.5 to about 15.0.

2. The flat electrical cable of claim 1, wherein t/D is in a range from about 0.53 to about 1.10.

3. The flat electrical cable of claim 2, wherein $t_1/w_1$ is in a range from about 2.5 to about 13.5.

4. The flat electrical cable of claim 3, wherein $t_1/w_1$ is in a range from about 2.5 to about 5.0.

5. The flat electrical cable of claim 4, wherein $t_1/w_1$ is in a range from about 4.1 to about 5.0.

6. The flat electrical cable of claim 5, wherein the conductors are arranged at a pitch P, $P/w_1$ in a range from about 3.1 to about 25.5.

7. The flat electrical cable of claim 6, wherein $P/w_1$ is in a range from about 3.1 to about 9.5.

8. The flat electrical cable of claim 7, wherein $P/w_1$ is in a range from about 3.1 to about 5.5.

9. The flat electrical cable of claim 3, wherein $t_1$ is in a range from about 127 micrometers to about 635 micrometers.

10. The flat electrical cable of claim 1 further comprising first and second electrically conductive shielding films disposed on opposite first and second sides of and adhered to the insulating layer, each shielding film including a flat or contoured middle portion adhered to and covering the insulating layer and an end portion adhered to the other shielding film on each lateral end of the insulating layer.

11. The flat electrical cable of claim 10, wherein a force required to separate one of the first and second shielding films from the insulating layer along the length of the cable at a 180 degree peel angle is in a range from about 0.5 pounds/inch to about 2.5 pounds/inch.

12. The flat electrical cable of claim 10 further comprising an electrically insulating jacket longitudinally or spirally wrapped around the shielding films, a lateral end of the jacket overlapping and adhered to an opposite lateral end of the jacket.

13. The flat electrical cable of claim 12, wherein the jacket is adhered to the shielding films.

14. The flat electrical cable of claim 10 further comprising an electrically insulating jacket extruded over and fully surrounding the shielding films.

15. The flat electrical cable of claim 1 further comprising an electrically insulating jacket longitudinally or spirally wrapped around the insulating layer, a lateral end of the jacket overlapping and adhered to an opposite lateral end of the jacket.

16. The flat electrical cable of claim 1 further comprising an electrically insulating jacket extruded over and fully surrounding the insulating layer.

17. The flat electrical cable of claim 16, wherein the jacket is adhered to the insulating layer.

18. The flat electrical cable of claim 1, wherein the conductors are arranged at a pitch P, wherein (2t+D)/P is in a range from about 0.60 to about 1.30.

19. The flat electrical cable of claim 18, wherein (2t+D)/P is in a range from about 0.70 to about 1.15.

20. The flat electrical cable of claim 1, wherein t is in a range from about 0.127 mm to about 0.325 mm.

21. The flat electrical cable of claim 20, wherein t is in a range from about 0.140 mm to about 0.325 mm.

22. The flat electrical cable of claim 1, wherein $w_1$ is in a range from about 50 micrometers to about 380 micrometers.

23. The flat electrical cable of claim 1, wherein the conductors are arranged at a pitch P, P in a range from about 0.40 mm to about 1.35 mm.

24. The flat electrical cable of claim 1, wherein D is in a range from about 0.127 mm to about 0.51 mm.

25. A cable assembly comprising:

a connector comprising:

an insulative housing including a longitudinal body portion having a plurality of contact openings extending therein in an insertion direction;

a plurality of electrical contact terminals supported in the contact openings; and a cover disposed on the housing and including a longitudinal body portion and first and second cover latches extending from opposing longitudinal ends thereof in the insertion direction and latched onto the housing; and the cable of claim 1 disposed between the cover and the housing, each contact terminal penetrating the insulating layer and making electrical and physical contact with a corresponding conductor.

* * * * *